US006299168B1

(12) United States Patent
Tyson

(10) Patent No.: US 6,299,168 B1
(45) Date of Patent: Oct. 9, 2001

(54) BOARD GAME

(76) Inventor: James W. Tyson, 317 Sunset La., Prince Frederick, MD (US) 20678

( * ) Notice: Subject to any disclaimer, the term of this patent is extended or adjusted under 35 U.S.C. 154(b) by 0 days.

(21) Appl. No.: 09/708,529

(22) Filed: Nov. 9, 2000

(51) Int. Cl.[7] ..... A63F 3/00
(52) U.S. Cl. ..... 273/243; 273/161
(58) Field of Search ..... 273/243, 252, 273/254, 256, 161, 429, 430, 431

(56) References Cited

U.S. PATENT DOCUMENTS

| | | | |
|---|---|---|---|
| D. 211,592 | | 7/1968 | Schultz . |
| 821,348 | * | 5/1906 | Fatkin et al. . |
| 3,658,337 | | 4/1972 | Peters et al. . |
| 3,874,671 | | 4/1975 | Smith . |
| 4,201,388 | | 5/1980 | Cantelon . |
| 4,396,195 | | 8/1983 | Roddy . |
| 4,966,372 | | 10/1990 | Robison . |
| 5,931,469 | | 8/1999 | Stichnoth . |
| 6,065,749 | * | 5/2000 | Debie . |

* cited by examiner

*Primary Examiner*—William M. Pierce
(74) *Attorney, Agent, or Firm*—Stephen R. Greiner

(57) ABSTRACT

A board game having a future-predicting theme. The game includes a rectangular board having a sinuous path printed thereon. Along the path are a number of future-predicting stations illustrated as circles with numbered segments each of which defining a future event like: marriage age, career choice, and place of residence. The numbers of the segments correspond to the numbers that may be selected by a chance device. Players, in turn, proceed along the path making predictions about their lives by choosing a number at a station and, then, rotating the spinner. The difference, if any, between the predicted number and the one found by the spinner is tallied. The player with the lowest cumulative tally after traversing the path is declared the winner.

3 Claims, 2 Drawing Sheets

BOARD GAME

FIELD OF THE INVENTION

The present invention relates generally to amusement devices and, in particular, to board games wherein a chance device controls the movement of a game piece over a board with a pattern.

BACKGROUND OF THE INVENTION

Predicting future events has, through the ages, been a popular pastime. Many individuals have claimed the ability to tell what is going to happen in another's life by reading cards, palms, weather signs, ouija boards and the like. Since such readings usually require some sort of experience to perform them, professionals now typically do them in exchange for money. Such drawbacks keep amateurs from participating in activities involving the prediction of future events for fun.

SUMMARY OF THE INVENTION

In light of the problems associated with known methods and apparatus for predicting the future for fun and amusement, it is a principal object of the invention to provide a board game wherein participants attempt to match their own wishes regarding the outcomes of a select group of future events with outcomes predicted by a chance device. The winner of the game is the player who most closely matches his wishes to those determined by the chance device.

It is another object of the invention to provide a board game that is simple to play, requiring minimal training, and that may be enjoyed by children and adults alike.

It is an object of the invention to provide improved elements and arrangements thereof in a board game for the purposes described which is lightweight in construction, inexpensive to manufacture, and dependable in use.

Briefly, the board game in accordance with this invention achieves the intended objects by featuring a game board having a path with a number of stations representing lifestyle choices or events along its length. Each station is subdivided into segments having one portion with a symbol representing a response to the choice presented by the station and another portion with a number. A spinner-type, chance device for generating random numbers is used to predict a player's choice at any station. A tally sheet has identifiers representative of the stations on the game board. On blank lines adjacent the identifiers, a player scribes numbers representing his preferred choices posed at the stations. On other blank lines adjacent the first, a player scribes numbers generated by the chance device. On still other blank lines, a player scribes the absolute value of the difference between the numbers scribed on the first and second blank lines adjacent each identifier. The player with the lowest total difference at the end of play is declared the winner of the game.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
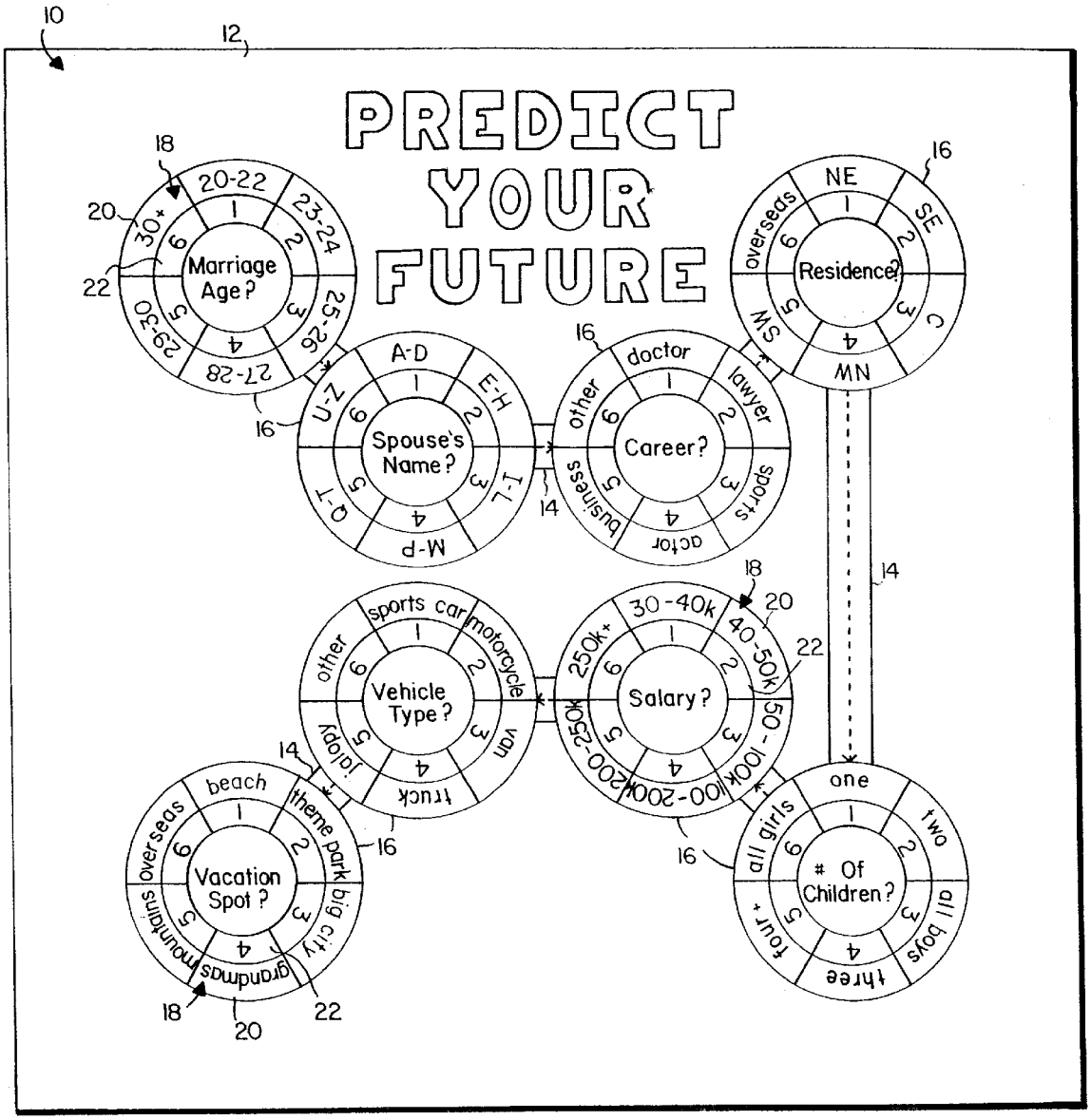
FIG. 1 is a top view of a game board entitled "Predict Your Future."
Figure 3:
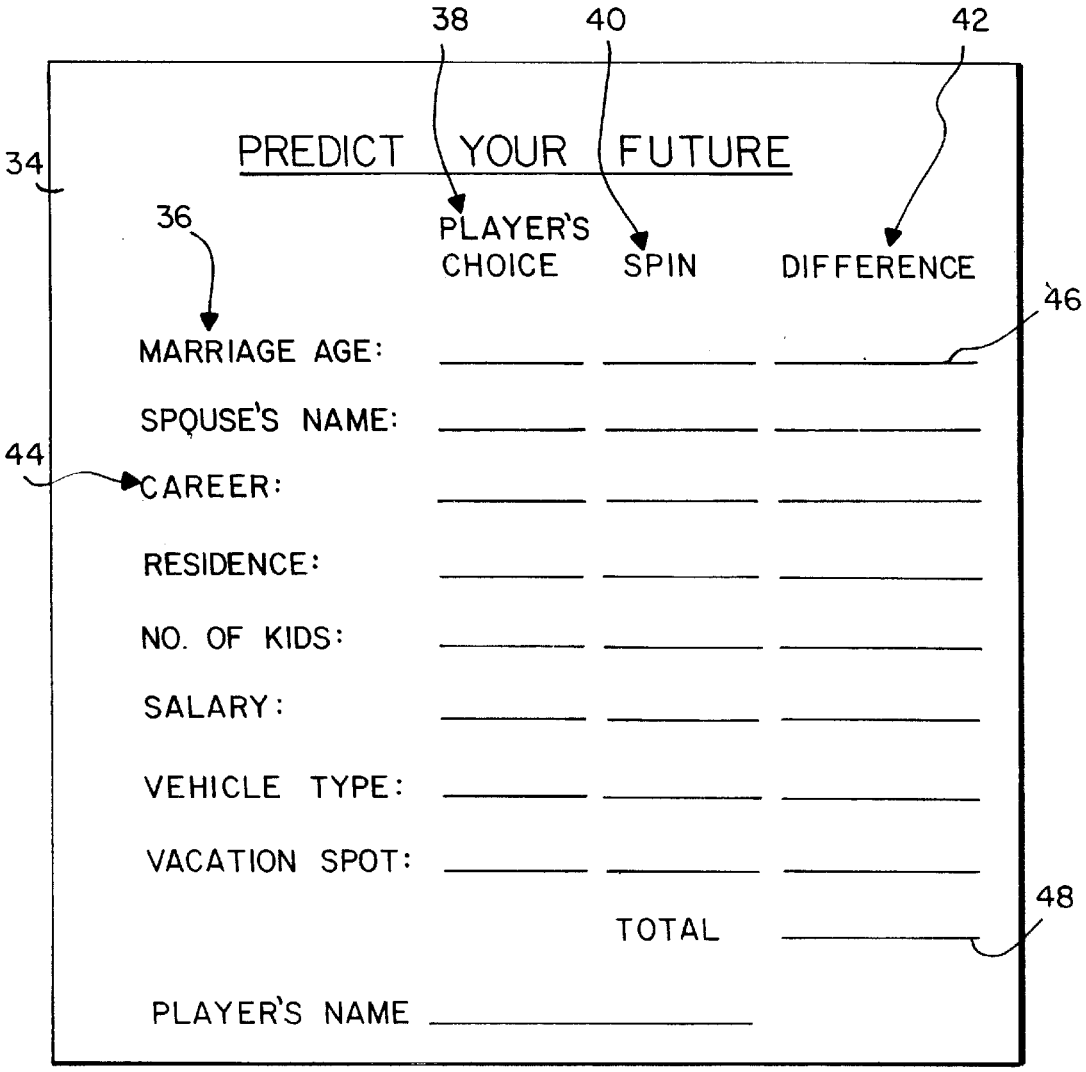
FIG. 3 is a top view of a tally sheet used with the game board of FIG. 1 and the tally sheet of FIG. 2.

Referring now to the FIGS., a game board in accordance with the present invention is shown at 10. Game board 10 includes a rectangular panel 12 having a sinuous path 14 printed upon, or otherwise applied to, its top. Along path 14 are a plurality of suitably marked stations 16 representative of events that an individual will likely face in his life. Each station 16 is divided into a plurality of segments 18 corresponding to the choices that an individual may make when confronted by a given event in his life. Each segment 18 has one portion 20 with printed indicia including a brief written description of a particular choice and another portion 22 with printed indicia including a number that corresponds to the choice. As each station 16 is preferably divided into six segments 18, each portion 22 is provided with a different, whole number ranging from 1 to 6.

Figure 2:
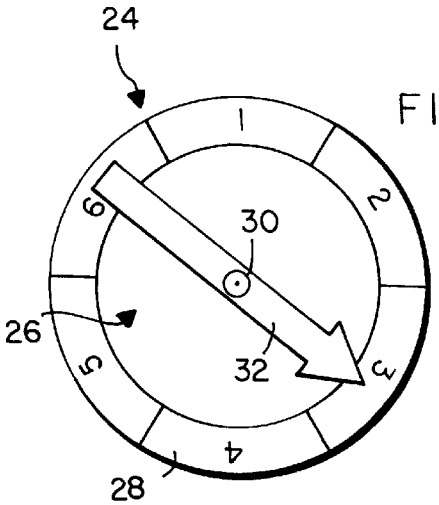
FIG. 2 is a top view of a chance device used with the game board of FIG. 1.
Figure 4:
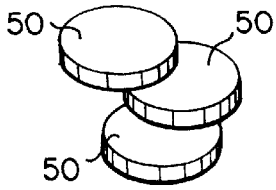
FIG. 4 is a perspective view of a plurality of game pieces movable over the game board by game players to mark their forward progress and future predictions.

A chance device 24 is used in conjunction with game board 10. Chance device 24 includes a circular plate 26 whose periphery is divided into a plurality of parts 28 corresponding in number with the segments 18 of each station 16. As there are preferably six segments 18, there are six parts 28 each being marked with printed indicia representative of a different, whole number ranging from 1 to 6. At the center of plate 26 is a pivot pin 30 carrying a spinner 32 that may, in conventional fashion, be spun by a player to point at one of the parts 28 to select a random number. Spinner 32 illustrated in FIG. 2 selects the number "3."

Tally sheet 34 is also used in conjunction with game board 10 and is provided with four columns 36, 38, 40, and 42 for holding information necessary for game play. Left-hand column 36 is preprinted and contains a plurality of identifiers 44, each being representative of a unique one of the stations 16 on game board 10. Columns 38, 40 and 42, however, contain a plurality of blank lines 46 arranged in rows adjacent to identifiers 44. At its top, column 38 is labeled as "Player's Choice," whereas column 40 is labeled as "Spin" and column 42 is labeled "Difference."

Onto each of the lines 46 in column 38, a player writes with a suitable marker (not shown) a number. This number will match that shown in one portion 22 of a station 16 on game board 10 that corresponds with an identifier 44 in the same horizontal row as a line 44 being written upon and, also, reflects a player's preferred choice in response to the event associated with that station 16 and identifier 44. For example, should a player believe that the best age for him to wed is 29 or 30 years of age, he would enter the number "5" in the blank line at the top of column 38. The remainder of the blank lines 46 in column 38 is completed in similar fashion with reference to the remaining stations 16 at the outset of the game.

Onto each of the lines 46 in column 40, a player will write a number that corresponds with that selected by chance device 24 during any turn of play. This particular number represents a prediction of how a player will actually respond to an event designated by a station 16. So, should a player spin a "2" on his first turn, he will have the prediction of chance device 24 that he will marry between the ages of 23 and 24 years. A "2," therefore, would be inserted onto the first line of column 40. The remainder of the blank lines 46 in column 40 is filled in as each player proceeds, in turn, down path 14 from one station 16 to another.

The absolute value of the difference between the numbers in each row of columns 38 and 40 is entered onto the lines of column 42. For example, should there be a "2" on the first line of column 38 and a "2" on the first line of column 40, their difference is "0" which is entered onto the first line of column 42. Further, should there be a "5" on the second line of column 38 and a "1" on the second line of column 40, the absolute value of their difference is "4" which is entered onto the second line of column 42. Finally, should there be a "1" on the third line of column 38 and a "6" on the third line of column 40, the absolute value of their difference is "5" which is entered onto the third line of column 42. The actual differences, of course, are calculated on a line-by-line basis by each player with the numbers presented during game play.

The numbers entered onto the lines 46 of column 42 are summed for each player and entered onto a line 48 marked "Total" at the bottom of each tally sheet 34. The totals are compared among the players. The player with the lowest total is the one who most closely matched his life choices with those determined by chance device 24 and is declared the winner of the game.

The progress of game players over path 14 is denoted by game pieces 50 each having a unique identifying characteristic such as a matchless color. At the outset of game play, each player is issued one game piece 50 which he will place upon the segment 18 of the first station 16 on path 14 that best reflects his choice and mimics the number placed upon the first line 46 of column 38. As game play proceeds, game pieces 50 are similarly positioned at the other stations 16. Thus, during game play, all players can see what their competitors' predictions at a given station 16 are without having to peer at tally sheets 34.

The eight stations 16 provided along path 14 in the preferred embodiment of the board game represent arbitrary, albeit important, events in a player's life. Among the events selected are: the age at which one will marry, the first letter of the first name that one will marry, one's career choice, the region of the U.S.A. within which one will live, the number of children one will have, one's preferred salary, the type of vehicle one will drive, and one's preferred vacation location. Events that could be associated with stations 16 in further embodiments of the invention might include, among others, one's preferred: housing arrangement, education level, children's gender, and pets.

The choices represented by the segments 18 found within each of the stations 16 are arbitrary but realistic in this sociological climate. For example, at the station dealing with marriage age, a player can select from segments 18 representing age ranges from 20–22, 23–24, 25–26, 27–28, 29–30 and 30+years. Similarly, career choices associated with the third station 16 include: doctor, lawyer, sports figure, actor, business person and other. In the end, the only things required of the choices shown by segments 18 is that they be interesting so as to hold the players' attention and that they correspond in number to the number of selections that can be generated by chance device 24.

Game play is straightforward and there is no limit upon the number of players. First, each player completes column 38 of tally sheet 34 with reference to the stations 16 and segments 18 on game board 10. Next, each player positions his game piece 50 on segment 18 of the first station 16 along path 14 that represents a life choice, here marriage age. Then, each player, in turn, spins spinner 32 of chance device 24 to predict, for example, the actual age when the player will be married. The number determined by chance device 24 is recorded in column 40 of tally 10 sheet 34. The previous three steps are repeated at each succeeding station 16 along path 14 and the absolute values of the differences between the numbers recorded in columns 38 and 40 are placed in column 42. The player with the lowest total difference is declared the winner of a game that is easy and fun to play.

While the invention has been described with a high degree of particularity, it will be appreciated by those skilled in the art that modifications may be made thereto. For example, the number and location of the stations 16 as well as the segments 18 are a matter of design choice and may be varied as desired. Furthermore, chance device 24 may be incorporated into the top of game board 10 thereby eliminating the need for a separate plate 26. Also, numbered cards or multi-sided die may be substituted for chance device 24 but are believed to be more cumbersome to use. Therefore, it is to be understood that the present invention is not limited to the sole embodiment described above, but encompasses any and all embodiments within the scope of the following claims.

I claim:

1. A board game, comprising:

a game board having upon its top a sinuous path and a plurality of stations representing questions located at spaced intervals along said path, each of said stations being subdivided into a plurality of segments, each of said segments having one portion bearing indicia in the form of a symbol representing an answer to the question posed by said station from which said segment was subdivided and another portion bearing indicia in the form of a unique number, each said number falling in the range of 1 to n with n being the number of said segments of any one said station, all of said stations having an equal number of said segments;

a chance device for generating random numbers falling within said range of 1 to n; and, a tally sheet having a plurality of columns provided thereon, one of said columns bearing indicia in the form of a plurality of identifiers each being representative of a respective one of said stations upon said game board, another of said columns bearing indicia in the form of a plurality of first blank lines each being adjacent to one of said identifiers upon which a player may scribe one said number representing a preferred answer, still another of said columns bearing indicia in the form of a plurality of second blank lines each being adjacent to one of said first blank lines upon which a player may scribe one said number generated by said chance device; and still another of said columns bearing indicia in the form of a plurality of third blank lines each being adjacent to one of said second blank lines upon which a player may scribe the absolute value of the difference between said number scribed on said first blank line and said number scribed on said second blank line adjacent each said identifier.

2. A board game, comprising:

a game board having upon its top a sinuous path and a plurality of stations representing questions located at spaced intervals along said path, each of said stations being subdivided into a plurality of segments, each of said segments having one portion bearing indicia in the form of a symbol representing an answer to the question posed by said station from which said segment was subdivided and another portion bearing indicia in the form of a unique number, each said number falling in the range of 1 to n with n being the number of said segments of any one said station, all of said stations having an equal number of said segments;

a chance device for generating random numbers falling within said range of 1 to n, said chance device including a plate subdivided into n parts and a spinner pivotally attached to said plate so as to point at any one of said parts; and, a tally sheet having a plurality of columns provided thereon, one of said columns bearing indicia in the form of a plurality of identifiers each being representative of a respective one of said stations upon said game board, another of said columns bearing indicia in the form of a plurality of first blank lines each being adjacent to one of said identifiers upon which a player may scribe one said number representing a preferred answer, still another of said columns bearing indicia in the form of a plurality of second blank lines each being adjacent to one of said first blank lines upon which a player may scribe one said number generated by said chance device; still another of said columns bearing indicia in the form of a plurality of third blank lines each being adjacent to one of said second blank lines upon which a player may scribe the absolute value of the difference between said number scribed on said first blank line and said number scribed on said second blank line adjacent each said identifier, and a fourth blank line beneath said third blank lines upon which the total of said numbers scribed upon said third blank lines may be scribed.

3. A board game wherein players can attempt to predict the future, said board game comprising:

a game board having upon its top a path and a plurality of stations representing lifestyle questions located at spaced intervals along said path, each of said stations being subdivided into a plurality of segments, each of said segments having one portion bearing indicia in the form of a symbol representing an answer to the lifestyle question posed by said station from which said segment was subdivided and another portion bearing indicia in the form of a unique number, each said number falling in the range of 1 to n with n being the number of said segments of any one said station, all of said stations having an equal number of said segments; a chance device for generating random numbers falling within said range of 1 to n, said chance device including a plate subdivided into n parts wherein each of said parts bears indicia in the form of a unique number, each said number falling in the range of 1 to n, and a spinner pivotally attached to said plate so as to point at any one of said parts; and, a tally sheet having a plurality of columns provided thereon, one of said columns bearing indicia in the form of a plurality of identifiers each being representative of a respective one of said stations upon said game board, another of said columns bearing indicia in the form of a plurality of first blank lines each being positioned adjacent to one of said identifiers upon which a player may scribe one said number representing a preferred answer, still another of said columns bearing indicia in the form of a plurality of second blank lines each being positioned adjacent to one of said first blank lines upon which a player may scribe one said number generated by said chance device; still another of said columns bearing indicia in the form of a plurality of third blank lines each being positioned adjacent to one of said second blank lines upon which a player may scribe the absolute value of the difference between said number scribed on said first blank line and said number scribed on said second blank line adjacent each said identifier, and a fourth blank line beneath said third blank lines upon which the total of said numbers scribed upon said third blank lines may be scribed.

* * * * *